United States Patent [19]

Paroty

[11] 4,172,674

[45] Oct. 30, 1979

[54] WRITING INSTRUMENT

[75] Inventor: Jean-Marie Paroty, Ableiges, France

[73] Assignee: Interlight, Fribourg, Switzerland

[21] Appl. No.: 817,485

[22] Filed: Jul. 20, 1977

[30] Foreign Application Priority Data

Jul. 20, 1976 [FR] France ..... 76 22083

[51] Int. Cl.[2] ..... B43K 7/12; B43K 24/06

[52] U.S. Cl. ..... 401/116; 401/104

[58] Field of Search ..... 401/104–111, 401/116, 117, 198

[56] References Cited

U.S. PATENT DOCUMENTS

| | | | |
|---|---|---|---|
| 3,179,086 | 4/1965 | Owadano | 401/104 X |
| 3,272,184 | 9/1966 | Crowley | 410/116 |
| 3,436,160 | 4/1969 | Lanoie | 401/116 |

FOREIGN PATENT DOCUMENTS

| | | | |
|---|---|---|---|
| 477244 | 9/1951 | Canada | 401/116 |
| 368070 | 2/1921 | Fed. Rep. of Germany | 401/116 |
| 652112 | 10/1937 | Fed. Rep. of Germany | 401/117 |
| 2520434 | 11/1975 | Fed. Rep. of Germany | 401/106 |

*Primary Examiner*—Edgar S. Burr
*Assistant Examiner*—James R. Feyrer
*Attorney, Agent, or Firm*—Brisebois & Kruger

[57] ABSTRACT

A writing instrument with a pivoted closure at its upper end to close an opening through which a refill cartridge can be removed and replaced from a continuous body of the instrument. The closure is locked in its closed position by a sleeve-extension of the body which enters a close fitting axial groove of the closure and prevents the closure from pivoting to an open position. The sleeve and body move up and down with respect to the closure by rotating the body with respect to the closure.

12 Claims, 7 Drawing Figures

WRITING INSTRUMENT

The present invention relates to a writing instrument such as a fountain pen, ball point or felt tip pen, lead pen or other.

The instrument according to the invention is of the type containing in its body, a renewable element such as a cartridge or other replaceable element.

One already knows of numerous pens with a refill element, comprising a body, a refill element disposed in the body, the body including an upper closing part to permit the loading or the unloading of the refill and ultimately, a mechanism to permit the lowering of the refill for writing or its raising for retraction.

Presently known instruments do not however permit in general the use of refills of significant diameter because inserting the refill through the upper end requires a passageway of a corresponding diameter, and the relatively thick mechanism is found to be offset outside of the passageway and tends to exaggeratedly increase the diameter of the instrument.

It has already been proposed, for example in U.S. Pat. No. 2,240,992 to mount a fountain-pen body provided with a pen point, in a case having a smaller opening to permit the passage of the point. The case is formed by two parts capable of sliding and comprises at its lower extremity a trap door like pivoting closure capable of being held in either an open or closed position as a function of the relative position of the body of the pen with respect to an operating spring of the closure.

Such an arrangement is however relatively complex because of the need for a case in the form of two sliding parts and the operation of the closure by a spring. In addition, the insertion from (by) the lower end requires gripping the pen at the writing tip. Finally, the closure having to be open for the pen to be able to write, makes it very inconvenient to grip the pen during writing.

The present invention proposes to remedy these inconveniences and to provide a writing instrument which, without having an exaggerated diameter, permits the use of refills with large diameters, like for example disposable ballpoint pen or felt-tipped pen refills readily available in the retail trade, in a simple manner, which is economical, and is not detrimental to the appearance of the pen.

The invention has as its object a writing instrument comprising a body in the form of a case capable of receiving a refill in its interior, an opening permitting the passage of the refill and a cap for closing this opening constituted by a closure pivoted on a tubular casing axially movable on the body of the instrument between an upper position permitting the opening of the closure and a lower position locking the closure, the closure having at least one stop surface near its bottom and disposed, in the lower position of the tubular casing, against the side of the rim of the body of the instrument to prevent the closure from pivoting, characterized by the fact that the opening is at the upper extremity of the casing to permit the insertion and the extraction of the refill, the casing extends as a single part between the upper opening and a lower opening permitting the passage of the writing tip, and when the tubular casing is in the upper position to open the closure, the closure can pivot freely on the tubular casing.

It is understood that in this manner when the refill is inserted in the body of the pen, if one makes the tubular casing slide downward to place it nearer to the upper rim of the body, the lower surface of the closure rests on the extremity of the refill and presses it downward against a conventional elastic return means until it causes the emergence of the writing tip at the lower part of the body. Moreover, the closure can perfectly support the push transmitted by the elastic means to the refill due to the fact that it is immobilized in the lower position, all pivoting being prevented by its overlapping of the upper part of the body.

Preferably, the movement between the body and the tubular casing can be realized in a helicoidal fashion by cooperation of a helical slot with a finger entering into the slot. This permits especially, by correctly orienting the end of the slot, to assure locking at the lowered position of the tubular casing. However, other means of locking the tubular casing in the lowered position can be provided.

In a particularly advantageous embodiment, the tubular casing comprises an internal part forming the opening for the passage of the refill and an external peripheral part separated from the internal part by a thin annular space receiving the extreme upper rim of the body, the slot or slots of the closure being presented at the top of this space. Thus when one makes this element or tubular casing slide downward, the upper rim of the body seats in the slot or preferably the slots provided in the closure.

For this purpose, the closure can advantageously have a circular part serving as a cover and a dimetrical internal rib having two gaps or slots to receive the rim of the body.

At the limit, however, the slots are able to have only a single edge and to be replaced by one or two axial surfaces of the closure extending axially over a sufficient length and being placed, in the lowered position, against the internal or external surface of the body to thus prevent the pivoting of the closure.

In an advantageous fashion, the tubular casing can comprise lower elastic arms which terinate in parts tapered radially towards the outside, one of these arms in addition, being able to have, for example, an external radial finger. The tubular casing can then cooperate with a terminal part of the body, which can preferably be made in the form of a bushing attached to the body and having a helical slot or a helical gap, the bushing having a diameter less than the diameter of the rest of the body so that its lower extremity forms a shoulder. When one inserts the tubular casing inside the bushing by bringing the flexible arms of the tubular casing in a position bent towards the axis of the tubular casing one can thus make the arms and the finger or protrusion on one of the arms pass through. When the protrusion arrives in front of the slot, the arm can free itself and the tab can pass into the helical slot. Simultaneously, the lower thickened part of the arms positions itself under the shoulder formed by the bushing and a total withdrawal of the tubular casing out of the body of the pen is then impossible, without a special tool, only the movement between the two already mentioned upper and lower positions being permitted.

Other advantages and characteristics of the invention will become apparent upon consideration of the following description, given as a non-limiting example and refering to the attached drawings, in which.

Figure 1:
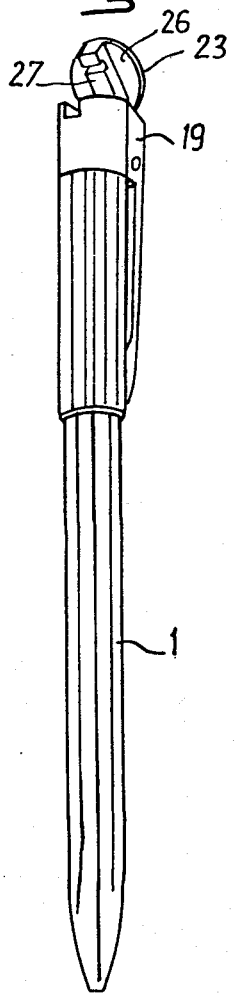
FIG. 1 is a view in perspective of the body of the pen disposed vertically.
Figure 2:
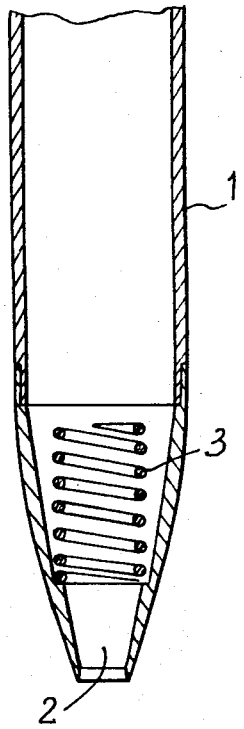
FIG. 2 is a sectional view of the lower portion of the body of the pen.
Figure 3:
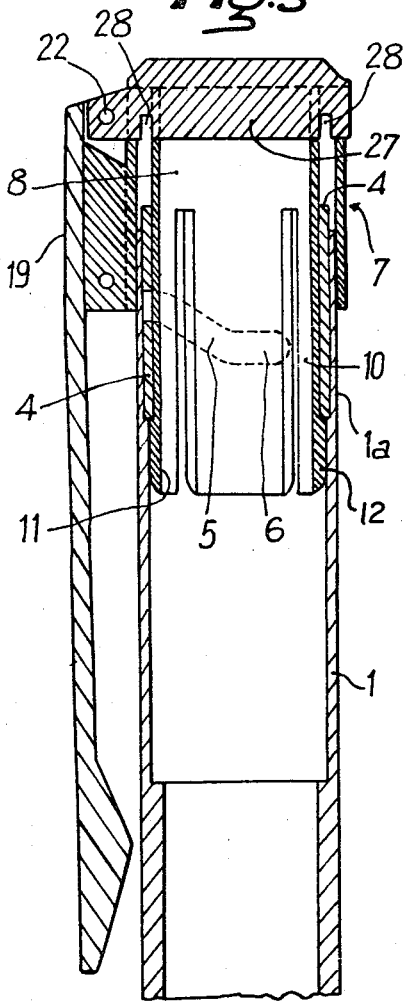
Figure 4:
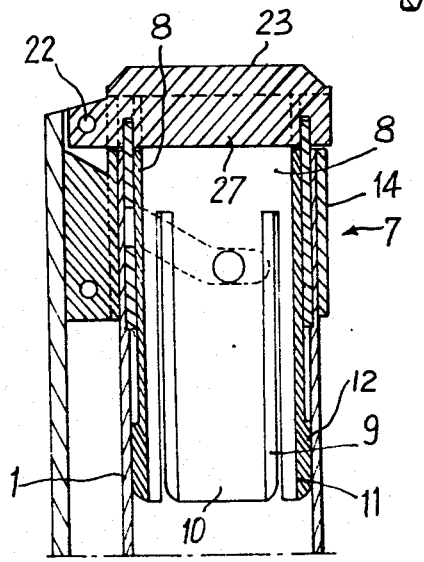
Figure 5:
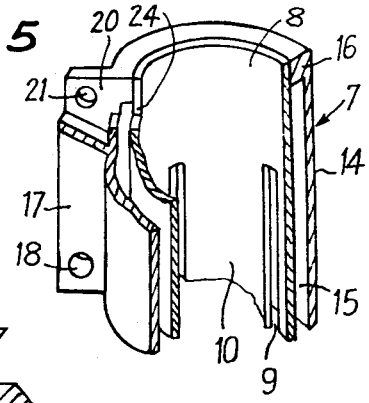
Figure 6:
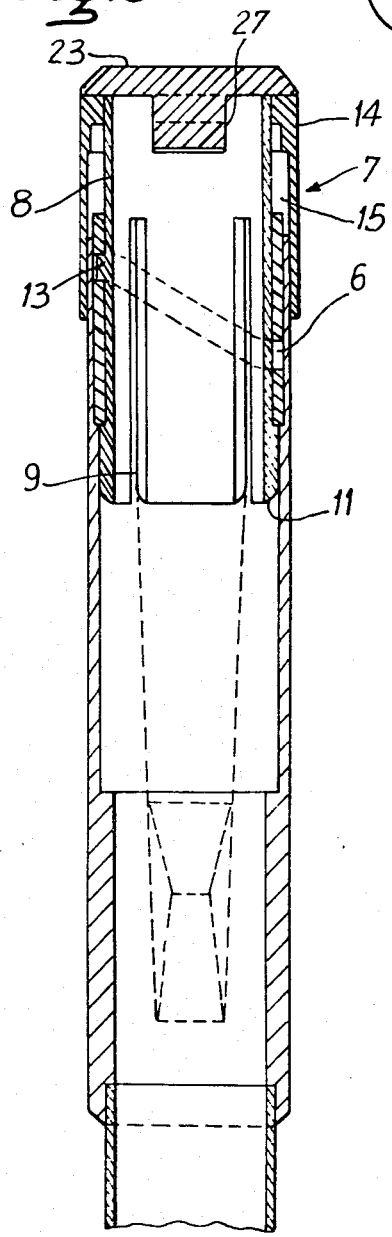
Figure 7:
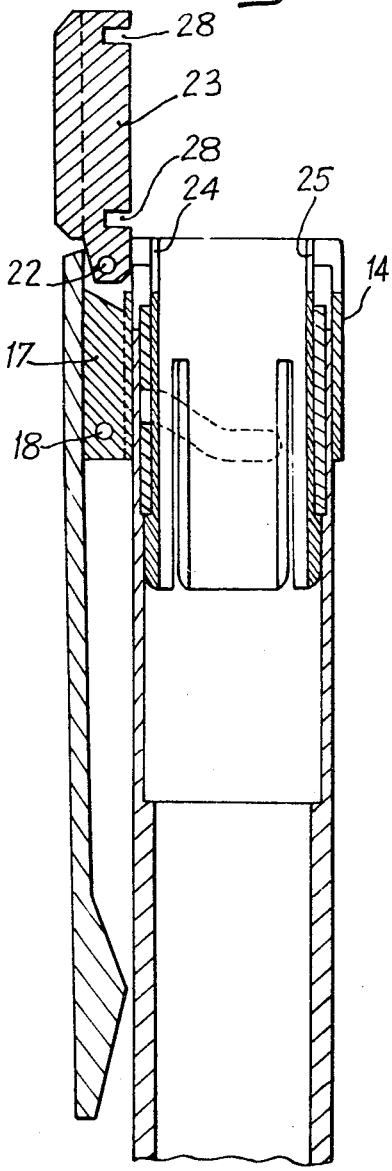

FIG. 3 is a sectional view of the upper part of the body of the pen, the closure being in a closed position but the tubular casing being in the upper position, FIG. 4 is a view corresponding to FIG. 3, the tubular casing being in the lowered position, FIG. 5 is a partial view in transversal section of the tubular casing, FIG. 6 is a view corresponding to that of FIG. 3 but with an axial section angularly displaced by 90°, and FIG. 7 is a view corresponding to that of FIG. 3 with the closure open.

The pen shown has a cylindrical hollow body 1 curved inwardly towards the bottom, and an end opening 2. A compression spring 3 is disposed adjacent to the opening 2 to retract towards the top a cartridge such as for example a commercially available ball point pen, which would be disposed in the body 1.

The upper part of body 1 terminates in a thinned portion 1*a*, whose inside diameter is slightly greater than the inside diameter of the rest of the body 1. In this inside diameter of portion 1*a* is inserted and maintained either by welding or any other means for securing, a relatively high or long bushing 4 in which is formed, on about one-fourth of a turn, a helical slot 5 itself terminating in a lower essentially horizontal portion 6.

The control mechanism comprises a complex tubular casing designated in its entirety by 7 and whose construction is clearly shown in FIG. 5. This casing has a first inner sleeve 8 with a relatively thin wall, whose external diameter is essentially equal to the internal diameter of the larger bushing 4. This sleeve 8 has four vertical slots 9 extending from its lower edge and defining accordingly four elastic arms 10 extending along a portion of the height of the sleeve. The external surfaces of these arms 10 are increased in thickness at 11 at their lower extremities, forming in this manner radial retaining hooks 12. In addition, one of the arms 10 presents a finger or external radial pin 13, better seen in FIG. 6.

The casing 7 also has an external cylindrical part 14 in the form of a skirt extending parallel to the sleeve 8 to provide a space 15. This cylindrical piece 14 has at its upper portion an internal flange 16 by which it is soldered on the external periphery of the upper margin of sleeve 8. In addition this part 16 has a lateral extension 17 forming a radial leg of rectangular form. This radial leg is traversed by an opening 18 for fixing a clip 19 having a head in the shape of a U completely covering part 17. At its upper portion the extension 17 has a radial recess 20 with an inclined bottom whose two walls are penetrated by the openings 21 for receiving the pivot pin 22 of the closure 23. This pin 22 is not visible from the outside when the clip is mounted.

In addition, with regard to the recess 20, part 8 also has a slot 24 as well as a second diametrically opposed slot 25, prolonged by a corresponding slot at the upper part of external sleeve 14.

The closure 23 has a circular part in the form of a cover 26 which applies itself on the upper edge of part 14, and a thick diametral rib 27 provided with two arcuately curved slots 28, the sides of these slots forming stop surfaces to prevent pivoting of the cover 26 when the cover is in the position of FIG. 4 in which bushing 4 extends into the slots.

The operation of the device is as follows:

The closure being pivoted in an open position, as shown, for example, in FIG. 7, one inserts the refill (not shown) into the body 1. The lower part of the refill rests against spring 3 and the writing tip of the refill does not go out of opening 2. The user then presses the closure 23 down around its axis 2, and while holding this closure down he begins to rotate casing 7 by gripping part 14, particularly at the intermediate clip. This rotating movement around the longitudinal axis of the pen causes by the action of the helical slot 5 and of the pin 13, a descending movement of casing 7 in relation to the body 1, which pushes the refill towards the bottom against spring 3, and when tab 13 enters into part 6 of the slot, the writing tip is completely extended out of opening 2, the upper end of the refill pressing against the lower surface of rib 27. One has thus attained the position shown in FIG. 4 where it can be seen that, in the lowered position of the casing 7, the upper rim of part 4 which extends body 1 to some degree, is received in the slots 28 of the closure. The closure becomes thus blocked against any pivoting movement around its axis 22 and there is no risk of it being opened under the effect of the thrust of the upper extremity of the refill.

If one wants to remove the refill it is sufficient to turn the casing 7 in the opposite direction which causes the raising of part 7 and consequently permits the opening of the closure when the rim of the bushing 4 is disengaged from slots 28.

Of course, if desired it is likewise possible to provide an intermediate position in which the closure is not able to open but in which part 7 is sufficiently removed from its lowest position that the writing tip of the pen is completely brought back inside body 1 under the action of spring 3. It suffices, in order to be able to obtain such an intermediate position to give sufficient depth to slots 28.

Although the invention has been described in relation to a particular embodiment, it is to be understood that this is in no way limiting and that one can make various modifications in form or in material without going beyond either the scope or the spirit of the invention.

I claim:

1. A writing instrument comprising, a unitary hollow body having an upper end with an opening through which a refill can be inserted into the body and a lower end having an opening through which a writing tip of the refill can extend, said opening at the upper end being substantially larger than said opening at the lower end, sleeve means mounted on said upper end of the body for axial movement between an upper position and a lower position with respect to said body, a closure, means mounting said closure on said sleeve means for pivotal movement between an open position in which said upper end of said body is substantially open to receive the refill, and a closed position closing said upper end of the body, a stop surface on said closure, a stop surface on said upper end of said body, said stop surfaces, with said closure closed and said sleeve in said lower position, being in opposed adjacent relation to each other and comprising lock means to prevent pivoting of said cover to said open position, said stop surfaces, in said upper position of said sleeve, being spaced from each other to permit pivoting said closure to said open position, and cooperating means between said sleeve means and said body for retaining said sleeve means in said lower position.

2. A writing instrument according to claim 1 wherein said cooperating means between said sleeve means and said body comprises, interengaging means on said sleeve means and said body for moving said sleeve means between said upper and lower positions in response to rotation of the body with respect to the sleeve means.

3. A writing instrument according to claim 2 wherein said interengaging means for moving said sleeve means axially in response to rotation of the body with respect to the sleeve means comprises a helical slot in said body, and a finger on said sleeve means and extending into said slot.

4. A writing instrument according to claim 3 wherein at least one end of said helical slot is essentially perpendicular to the axial direction of movement of the sleeve means with respect to the body.

5. A writing instrument according to claim 1 wherein said sleeve means comprises a hollow sleeve extending into the upper end of said body and a peripheral part extending around the upper end of said body, and means above the end of the body for connecting said sleeve to said peripheral part.

6. A writing instrument according to claim 5 wherein said external peripheral part has a radial tab, and said means mounting said closure for pivotal movement comprises a pin pivoting said closure to said tab.

7. A writing instrument according to claim 1 wherein said body adjacent said upper end comprises means defining a downwardly facing shoulder, said sleeve means comprises a sleeve having downwardly extending elastic arms, and said arms having an upwardly facing shoulder cooperating with said downwardly facing shoulder of said body to prevent separation of said sleeve from said body.

8. A writing instrument according to claim 7 wherein said body has a helical slot, and a finger on one of said arms of said sleeve extends into said helical slot so that rotation of said sleeve with respect to said body moves said sleeve axially with respect to the body.

9. A writing instrument according to claim 8 wherein said upper portion of said body comprises a thin sidewall, a bushing extending into and fixed in said sidewall, a lower edge of said bushing defining said downwardly facing shoulder, and said helical slot being formed in said bushing.

10. A writing instrument according to claim 1 wherein said closure comprises a circular cap having a diametrically extending rib on its interior surface, said rib having slots spaced apart to receive opposite sides of said upper end of said body, sides of said slots comprising said stop surfaces on said closure, and sides of said body comprising said stop surfaces on said upper end of said body.

11. An instrument according to claim 10 wherein said sleeve means has two diametrically opposed recesses to receive said rib in the closed position of said closure.

12. A writing instrument according to claim 1 wherein said closure has at least one downwardly extending slot, and a side surface of said slot comprises said stop surface of said closure, said stop surface of said upper end of said body comprising a side surface of said body, said side surface of said body engaging said side surface of the slot to prevent pivotal movement of said closure in said lower position of said sleeve.

* * * * *